US005201622A

United States Patent [19]

Agopian et al.

[11] Patent Number: 5,201,622

[45] Date of Patent: Apr. 13, 1993

[54] TRAIN APPARATUS FOR REMOVING BLISTERS FROM A FIBER CONDUIT

[75] Inventors: Robert P. Agopian, 213 N. Lucerne Blvd., Los Angeles, Calif. 90004; Shoji Tanaka, Montebello, Calif.

[73] Assignee: Robert P. Agopian, Los Angeles, Calif.

[21] Appl. No.: 740,150

[22] Filed: Aug. 5, 1991

[51] Int. Cl.[5] ..... B08B 9/04

[52] U.S. Cl. ..... 409/299; 15/104.05

[58] Field of Search ..... 409/299, 143, 139; 15/104.05

[56] References Cited

U.S. PATENT DOCUMENTS

| | | | |
|---|---|---|---|
| 1,275,437 | 8/1918 | Jillson et al. | 409/299 X |
| 2,148,754 | 2/1939 | Jacobson | 15/104.05 |
| 4,326,893 | 4/1982 | Clifford | 15/104.05 X |

FOREIGN PATENT DOCUMENTS

| | | | |
|---|---|---|---|
| 214641 | 10/1905 | Fed. Rep. of Germany | 15/104.05 |
| 205352 | 9/1939 | Switzerland | 15/104.05 |
| 1279688 | 12/1986 | U.S.S.R. | 15/104.05 |

*Primary Examiner*—Z. R. Bilinsky

*Attorney, Agent, or Firm*—Thomas I. Rozsa; Dong Chen

[57] ABSTRACT

A train apparatus for removing thick blister buildups from an underground fiber conduit used for housing power cables. The train apparatus includes three or more cutting units including an initial, a middle and a final cutting unit having smallest, medium and largest overall cutting diameters respectively. Each cutting unit having a lead guide and six cutting stars each having four cutting blades where the cutting blades on one cutting star are offset with the cutting blades on the other cutting stars. When pulled through the fiber conduit, the lead guide of the cutting units will prevent the cutting unit from going off the center of the conduit and digging itself into the interior sidewall of the conduit. The initial, middle and final cutting units will remove respectively the surface, the intermediate and the underneath portions sequentially. The train apparatus further includes a trailing guide for preventing it from going off center of the conduit and digging itself into the interior sidewall of the conduit. When the train gets stuck inside the fiber conduit and it is necessary to pull it out backwardly, a cable will be attached to the trailing guide for this purpose.

24 Claims, 4 Drawing Sheets

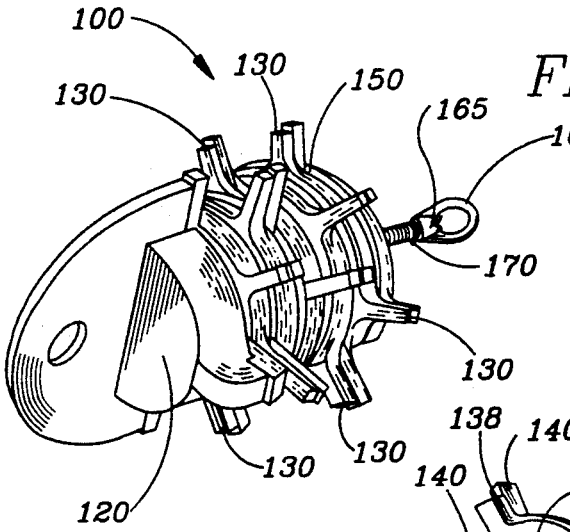
FIG. 1
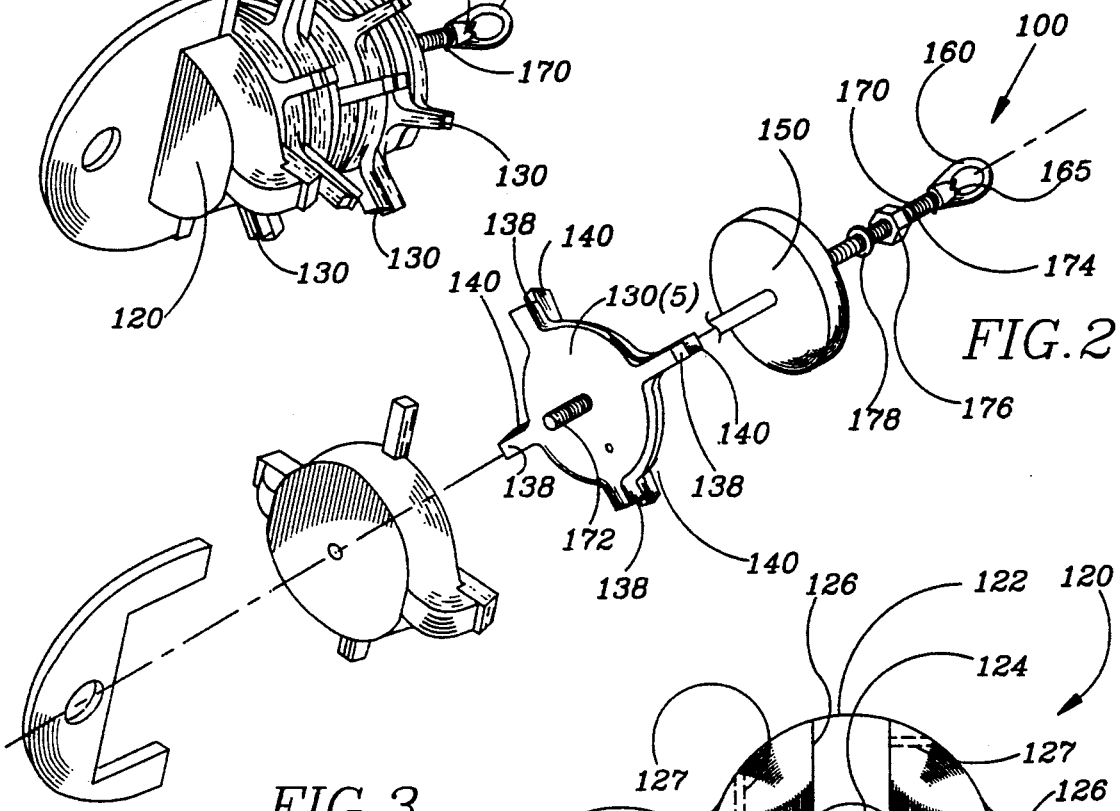
FIG. 2
FIG. 3
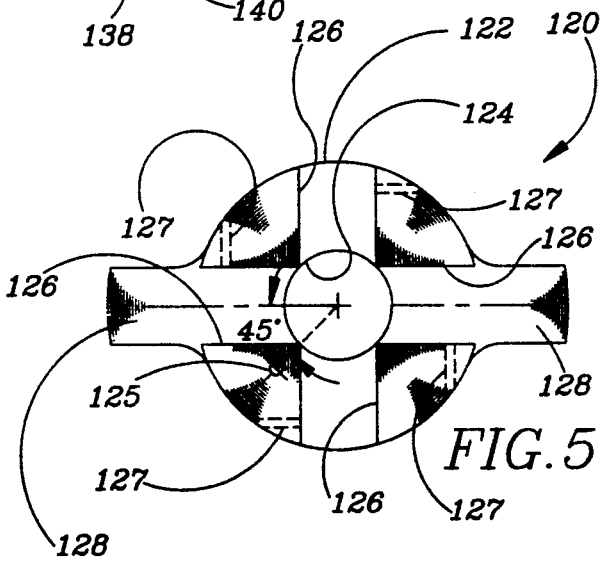
FIG. 5
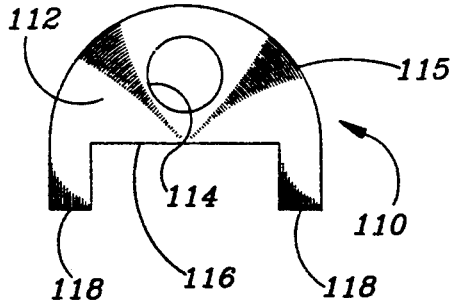
FIG. 6
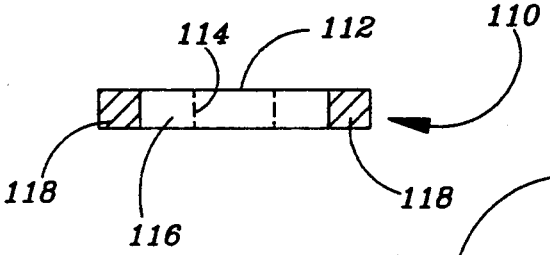
FIG. 4
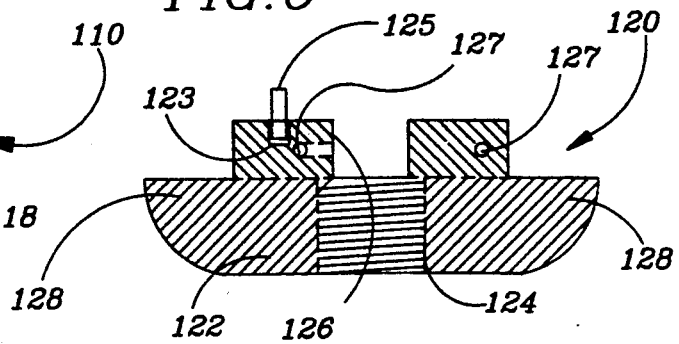

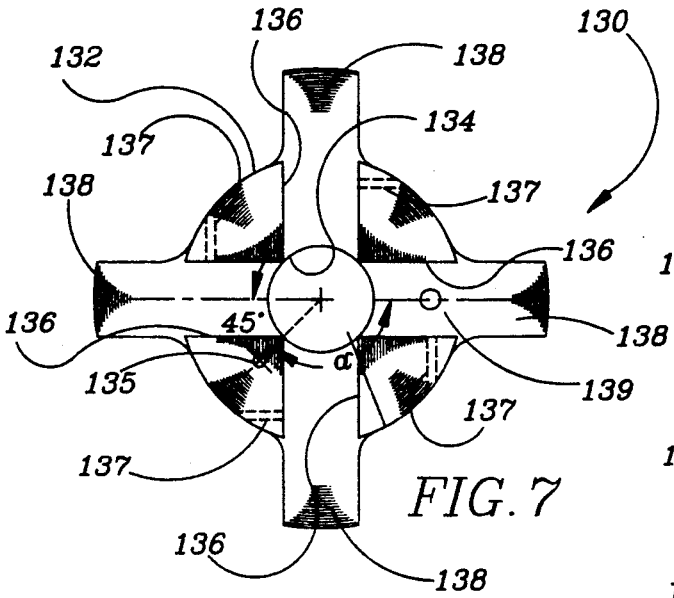
FIG. 7
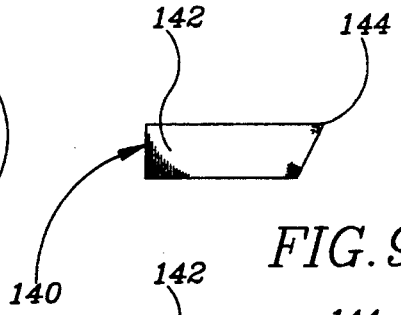
FIG. 9
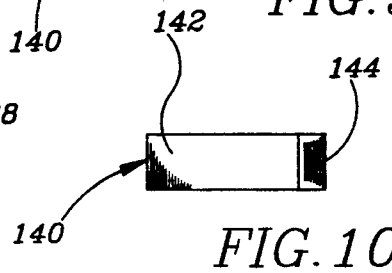
FIG. 10
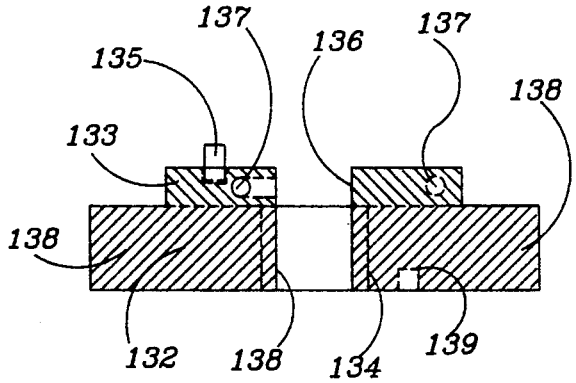
FIG. 8
FIG. 11
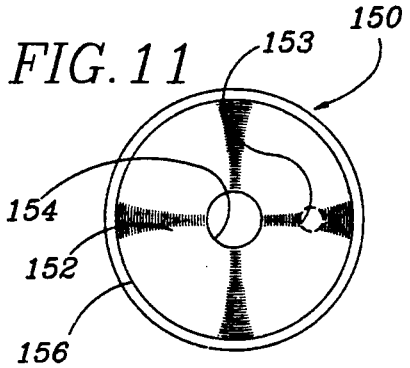
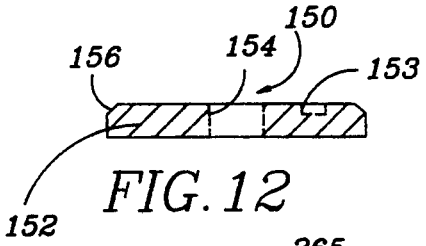
FIG. 12
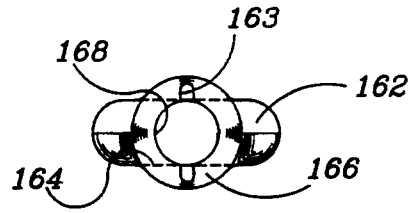
FIG. 14
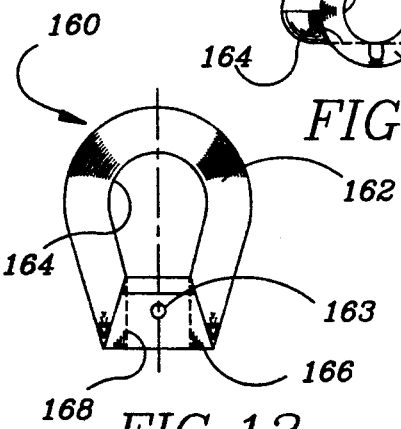
FIG. 13
FIG. 19
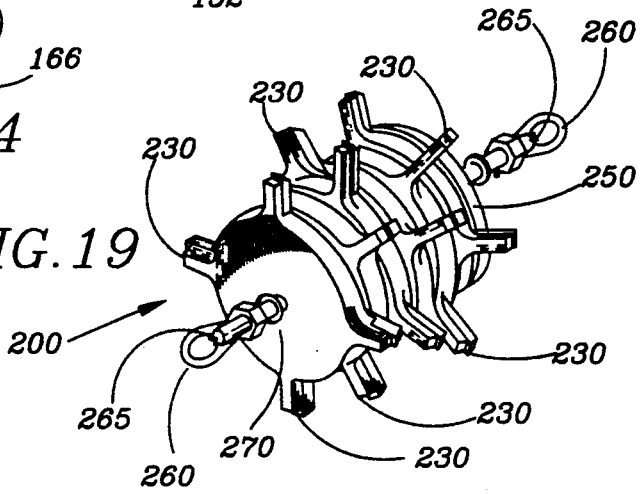

TRAIN APPARATUS FOR REMOVING BLISTERS FROM A FIBER CONDUIT

BACKGROUND OF THE INVENTION

1.Field of the Invention

The present invention relates to the field of removing blisters from a conduit. More particularly the present invention relates to the field of using a train apparatus for removing blisters from an underground fibrous conduit.

2. Description of the Prior Art

For many years, especially between the years of 1930 and 1960, and to some extent in the 1970's, a special type of conduit has been used to house underground electrical power cables. This special conduit is a fibrous duct made of wooden pulp impregnated with coal tar. The two most common interior diameters with which the ducts have been created are 4 inches interior diameter and 5 inches interior diameter. Over the years many such conduits have deteriorated and blisters have been built up in many of the underground ducts. The blisters extend for as much as 1 inch into the interior from the sidewalls of the ducts. The blisters formed in the interior of the ducts create a big problem for power network maintenance because the blisters block the openings in the ducts and prohibit cables from being placed through the ducts. In addition, the blisters squeeze existing cables. Although newer conduits have been made of plastic which do not have this problem, there are a lot of deteriorated fibrous conduits still buried underground. It is necessary to repair such conduits and remove the blisters, since it is cost prohibitive to remove all of these ducts out of the ground and replace them.

The blisters built up inside the power cable conduit made of fibrous material such as wood, create a major problem in maintaining and reconstructing existing residential houses and commercial buildings. Since the fibrous ducts are buried underground, it is hard to detect which portion of a duct has deteriorated with most blisters. The only practical solution is to dredge a large length of duct at once to remove all the blisters which have built up inside the duct. The average length of such power cable conduits is about one thousand feet. It is desirable to have a cleaning tool which can be pulled through the ducts by a cable, strong enough to scrape off the blisters, yet flexible enough to go through the twists and turns of the ducts.

SUMMARY OF THE PRESENT INVENTION

The present invention is a train apparatus for removing blisters from a fiber conduit.

It has been discovered, according to the present invention, that if a circular cutting star having a multiplicity of cutting blades is pulled though an underground duct, then the blisters built up inside the duct can be scraped off by the multiplicity of cutting blades when they come in contact with the blisters.

It has also been discovered, according to the present invention, that if four cutting blades are assembled onto a circular cutting star and the cutting blades are set 90° apart, then the scraping forces are evenly applied to the circular cutting star as it is being pulled through the underground duct.

It has further been discovered, according to the present invention, that if a multiplicity of circular cutting stars are assembled together as a cutting unit, and the four cutting blades of each circular cutting star are offset from all other cutting blades of other circular cutting stars, then when the cutting unit is pulled through a duct, all of the areas around the 360° circle of the cross-section of the duct can be covered.

It has additionally been discovered, according to the present invention, that if for a cutting unit, the four cutting blades of a circular cutting star are not sequentially offset from the cutting blades of the adjacent circular cutting star, then the cutting unit will not spiral and spin when pulled through a duct.

It has again been discovered, according to the present invention, that if a cutting unit has a lead guide having a large flat panel with arched rim, then when the cutting unit is pulled through a duct, the lead guide will prevent the cutting unit from going off the center of the duct and digging itself into the interior sidewall of the duct.

It has further been discovered, according to the present invention, that in the preferred embodiment, three cutting units with different overall cutting diameters are connected in series as a train apparatus. The one having the smallest overall cutting diameter is the initial unit, the one having the medium overall cutting diameter is the middle unit, and the one having the largest overall cutting diameter is the final unit. Therefore, when the train apparatus is pulled through a duct having thick blister buildups, the surface portion of the blister will be scraped off by the initial cutting unit, the intermediate portion of the blister will then be scraped off by the middle cutting unit, and the underneath portion of the blister adjacent to the interior sidewall of the duct will finally be scraped off by the final cutting unit.

It has also been discovered, according to the present invention, that if the train apparatus is further provided with a trailing guide having a large flat panel with arched rim and side wings, then when the train apparatus is stuck inside a duct and it is necessary to remove it, it is pulled out backwardly. The trailing guide can serve as a guide for preventing the train apparatus from going off center or digging itself into the interior sidewall of the duct.

It is therefore an object of the present invention to provide a cutting unit for removing blisters from a fiber conduit, where the cutting unit has a multiplicity of circular cutting stars, each cutting star has four cutting blades set 90° apart, and the four cutting blades of each circular cutting star are offset from all other cutting blades of other circular cutting stars, so that when the cutting unit is pulled through a duct, all of the areas around the 360° circle of the cross-section of the duct can be covered.

It is also an object of the present invention to provide a cutting unit having a multiplicity of circular cutting stars for removing blisters from a fiber conduit, where the four cutting blades of a circular cutting star are not sequentially, but instead are randomly offset from the cutting blades of the adjacent circular cutting star, so that the cutting unit will not spiral and spin when pulled through a duct.

It is an additional object of the present invention to provide a cutting unit for removing blisters from a fiber conduit, where the cutting unit has a lead guide having a large flat panel with arched rim, so that when the cutting unit is pulled through a duct, the lead guide will prevent the cutting unit from going off the center of the duct and digging itself into the interior sidewall of the duct.

It is a further object of the present invention to provide a train apparatus for removing blisters from a fiber conduit, where the train apparatus has three cutting units with different overall cutting diameters connected in series; such that the one having the smallest overall cutting diameter is the initial unit, the one having the medium overall cutting diameter is the middle unit, and the one having the largest overall cutting diameter is the final unit. Therefore when the train apparatus is pulled through a duct having thick blister buildups, the surface portion of the blister will be scraped off by the initial cutting unit, the intermediate portion of the blister will then be scraped off by the middle cutting unit, and the underneath portion of the blister adjacent to the interior sidewall of the duct will finally be scraped off by the final cutting unit.

It is again an object of the present invention to provide a train apparatus for removing blisters from a fiber conduit, where the train apparatus has three cutting units, where the train apparatus is further provided with a trailing guide having a large flat panel with arched rim and side wings, so that when the train apparatus is stuck inside a duct and it is necessary to pull it out backwardly, the trailing guide can serve as a guide for preventing the train apparatus from going off center or digging itself into the interior sidewall of the duct.

It is an additional object of the present invention to provide a marking system including numerals and symbols for identifying the multiplicity of cutting units and their respective multiplicity of circular cutting stars, so that after being disassembled and cleaned, they can be quickly assembled back together with proper size and orientation arrangements.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a preferred embodiment of a cutting unit of the present invention.

FIG. 2 is an exploded view of the preferred embodiment of the cutting unit of the present invention.

FIG. 3 is a side view of a lead guide of the cutting unit of the present invention.

FIG. 4 is an end view of the lead guide of the cutting unit of the present invention.

FIG. 5 is a side view of a lead cutting star of the cutting unit of the present invention.

FIG. 6 is an end view of the lead cutting star of the cutting unit of the present invention.

FIG. 7 is a side view of a regular cutting star of the cutting unit of the present invention.

FIG. 8 is an end view of the regular cutting star of the cutting unit of the present invention.

FIG. 9 is a side view of a cutting blade of the cutting unit of the present invention.

FIG. 10 is an end view of the cutting blade of the cutting unit of the present invention.

FIG. 11 is a side view of a circular clamp of the cutting unit of the present invention.

FIG. 12 is an end view of the circular clamp of the cutting unit of the present invention.

FIG. 13 is a side view of an eye nut of the cutting unit of the present invention.

FIG. 14 is an end view of the eye nut of the cutting unit of the present invention.

FIG. 19 is a perspective view of an alternative embodiment of a cutting unit of the present invention.

DETAILED DESCRIPTION OF THE PREFERRED EMBODIMENT

Figure 20:
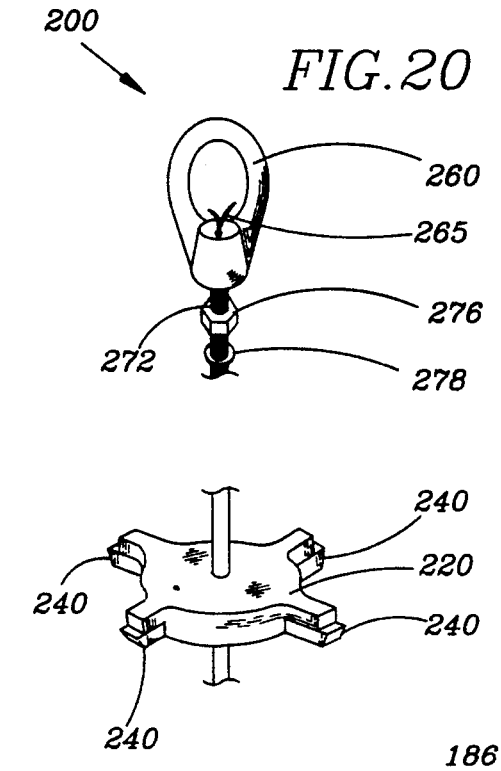
FIG. 20 is an exploded view of the alternative embodiment of the cutting unit of the present invention.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 and 2, there is shown at 100 a cutting unit for removing blisters from a fiber conduit. Cutting unit 100 has a lead guide 110, a lead cutting star 120 welded with lead guide 110, five regular cutting stars 130 and a circular clamp 150, all assembled on a longitudinally elongated central shaft 170. There are four cutting blades 140 mounted to each cutting star where the four blades are set 90° apart. The front end 172 of central shaft 170 is screwed into lead cutting star 120 and welded together with lead guide 110. A screw nut 176 is mounted to the rear end 174 of central shaft 170 with an "O" ring 178 inserted for fastening the assembly. An eye nut 160 is attached to rear end 174 of central shaft 170 by a small split pin 165.

The following figures, FIGS. 3–14, should be examined in conjunction with FIGS. 1 and 2.

Referring to FIGS. 3 and 4, there is shown at 110 the lead guide of cutting unit 100. Lead guide 110 has a large flat panel 112 having a central opening 114. It also has an arch-shaped front rim 115, and a vertical rear slot 116 for adapting lead cutting star 120. Two vertical rear arms 118 are formed adjacent to rear slot 116 for supporting the adjacent two vertically disposed cutting blades 140 mounted on lead cutting star 120.

Referring to FIGS. 5 and 6, there is shown at 120 the lead cutting star of cutting unit 100. Lead cutting star 120 has a disc-shaped body portion 122 having a longitudinal central opening 124 with inner screw threads. At the rear side of body portion 122 there are four transverse slots 126 set 90° apart for adapting the respective cutting blades 140. Lead cutting star 120 also has two oppositely disposed horizontal arms 128 for supporting two horizontally disposed cutting blades 140. There are four small through holes 127 adjacent to the four transverse slots 128 respectively. After a cutting blade 140 is inserted into a transverse slot 128, it can be secured by an Allen screw which is threaded through small hole 127. Each blade 140 is positioned to just slightly extend out from the tip of a respective horizontal arm 128.

Lead guide 110 and lead cutting star 120 are welded together with the front end 172 of central shaft 170 threaded in longitudinal central opening 124 of lead cutting star 120, such that the two rear arms 118 of lead guide 110 and the two horizontal arms 128 of lead cutting star 120 are set 90° apart, and each of the two blades 140 adjacent to the two rear arms 118 of lead guide 110 is positioned to just slightly extend out from the tip of a respective rear arm 118 of lead guide. In other words, the vertically disposed pair of the four blades 140 mounted on lead cutting star 120 are adjacent to, and guided and protected by, the two vertical rear arms 118 of lead guide 110, and the horizontally disposed pair of the four blades 140 mounted on lead cutting star 120 are adjacent to, and guided and protected by, the two horizontal arms 128 of lead cutting star 120.

On the rear side of lead cutting star 120 there is a small hole 123 and there is a small shaft 125 inserted therein. Small shaft 125 is located on a radius of disc-shaped body portion 122 where the angle between the radius and one of the two horizontal arms 128 is 45°. The function of small shaft 125 will be discussed later.

It will be helpful to define an angle system for describing the orientations of the cutting stars more clearly. Referring to FIGS. 1 and 2, the angle system is defined as: looking from lead guide 110 to eye nut 160 along the axis of central shaft 170, angular measurement starts from right horizontal arm of lead cutting star 120 and increases in the clockwise direction. According to this system, the two vertical rear arms 118 of lead guide 110 are located at 90° and 270° respectively, and the two horizontal arms 128 of lead cutting star 120 are located at 0° and 180° respectively. Therefore the four cutting blades 140 of lead cutting star 120 are located at 0°, 90°, 180°, and 270° respectively, and small shaft 125 at the rear side of lead cutting star 120 is located at 315°.

There are all together six cutting stars assembled in each cutting unit 100. The first cutting star is lead cutting star 120, and the other five cutting stars are regular cutting stars 130. Referring to FIGS. 7 and 8, there is shown at 130 one of the five regular cutting stars of cutting unit 100. Regular cutting star 130 has a disc-shaped body portion 132 having a longitudinal central opening 134. At the rear side of body portion 132 there are four transverse slots 136 set 90° apart for adapting the respective cutting blades 140. Regular cutting star 130 also has four lateral arms 138 set 90° apart and located adjacent to transverse slots 136 for supporting four respective cutting blades 140. There are four small through holes 137 adjacent to the four transverse slots 138 respectively. After a cutting blade 140 is inserted into a transverse slot 138, it can be secured by an Allen screw which is threaded through small hole 137. Each blade 140 is positioned to just slightly extend out from the tip of a respective lateral arm 138, and is thereby guided and protected.

On the rear side of regular cutting star 130 there is a small hole 133 and there is a small shaft 135 inserted therein, and on the front side of regular cutting star 130 there is a small hole 139. Small shaft 135 is located on a first radius, where the angle between the first radius and one of the four lateral arms 138 is 45°; and small hole 139 is located on a second radius, where the angle between the first radius and the second radius is $\alpha$. Small shaft 135 on the rear side of each regular cutting star is designed for engaging into small hole 139 on the front side of the following regular cutting star, and vice versa, small hole 139 on the front side of each regular cutting star is designed for adapting small shaft 135 on the rear side of the preceding regular cutting star. Of course small hole 139 on the front side of the regular cutting star which is next to lead cutting star 120 accommodates small shaft 125 on the rear side of lead cutting star 120, and small shaft 135 on the rear side of the last regular cutting star is engaged into a small hole on the front side of circular clamp 150, which will be described in detail later.

The lead cutting star 120 is numbered as the first cutting star. The regular cutting star which is next to the lead cutting star 120 is numbered as the second cutting star, and the rest of the regular cutting stars are sequentially numbered as the third, fourth, fifth and sixth cutting stars respectively.

Particularly referring to FIG. 7, there is shown that small shaft 135 is located on the rear side of regular cutting star 130 along a first radius, and small hole 139 is located on the front side of regular cutting star 130 along a second radius. The angle between the first radius and one of the four lateral arms 138 is 45°, and the angle between the first radius and the second radius is $\alpha$. For the second, fourth and sixth cutting stars, angle $\alpha$ is 135°, for the third cutting star, angle $\alpha$ is 105°, and for the fifth cutting star, angle $\alpha$ is 150°. Therefore for the second, fourth and sixth cutting star, the respective small hole 139 on the front side is located on a radius aligned with a lateral arm; and for the third and fifth cutting stars the respective small hole 139 on the front side is located on a radius offset from the lateral arm and the offset angles are 30° and 15° respectively.

It has been described already that the small shaft 125 at the rear side of lead cutting star 120 (the first cutting star) is located at 315°, and the four cutting blades 140 of lead cutting star 120 are located at 0°, 90°, 180°, and 270° respectively. Accordingly, the following angular degree orientations of the first through the sixth cutting stars have been established and shown in Table 1 below (in unit of degrees).

TABLE 1

| Star | Front Hole | Rear Shaft | Cutting Blades |
|---|---|---|---|
| 1st | N/A | 315 | 0, 90, 180, 270 |
| 2nd | 315 | 90 | 45, 135, 225, 315 |
| 3rd | 90 | 195 | 60, 150, 240, 330 |
| 4th | 195 | 330 | 15, 105, 195, 285 |
| 5th | 330 | 120 | 75, 165, 255, 345 |
| 6th | 120 | 255 | 30, 120, 210, 300 |

From Table 1 it can be seen that (a) the angular position of the small hole on the front side of a following cutting star matches the angular position of the small shaft on the rear side of a preceding cutting star; (b) the difference between the angular positions of the small hole on the front side and the small shaft on the rear side of a cutting star is angle $\alpha$; (c) for the second, fourth and sixth cutting star, the small hole on the front side is located on a radius aligned with a lateral arm; and (d) for the third and fifth cutting stars the small hole on the front side is located on a radius offset from the lateral arm and the offset angles are $-30°$ and $+15°$ respectively. Therefore all the areas around a 360° circle are covered by respective cutting blades. However, the angular arrangement of the cutting stars is designed in such a manner that the cutting blades of adjacent cutting stars are not sequentially offset, so that the assembled cutting unit will not spiral and spin when pulled through the duct, and debris can get through the spaces between the cutting blades of adjacent cutting stars.

Referring to FIGS. 9 and 10, there is shown at 140 the cutting blade of cutting unit 100. Cutting blade 140 has a generally rectangular shaped body portion 142 with a sharp cutting edge 144. Cutting blade 140 is preferably made of tungsten carbide steel and comparable to a broaching tool, serves to shave off the layer of blister which it comes in contact with.

Referring to FIGS. 11 and 12, there is shown at 150 the circular clamp of cutting unit 100. Circular clamp 150 has a disc-shaped body portion 152 having a central opening 154. The rear side rim 156 of circular clamp 150 is rounded. On the front side of circular clamp 150 there is a small hole 153 for accommodating the small shaft 135 on the rear side of the last cutting star.

After circular clamp 150 is assembled onto central shaft 170, a screw nut 176 is threaded onto the rear end 174 of central shaft 170 with an "O" ring 178 inserted to fasten the assembly. The rear end 174 of longitudinal central shaft 170 further has a small transverse hole for receiving a split pin 165. An eye nut 160 is attached to the rear end 174 of central shaft 170 by split pin 165 for interlinking cutting unit 100 with a pulling cable or other cutting units. Referring to FIGS. 13 and 14, there is shown at 160 the eye nut of cutting unit 100. It has a stirrup portion 162 having an opening 164 for interlinking and a frusto-conical portion 166 having a longitudinal opening for receiving the rear end 174 of the longitudinal central shaft 170. The frusto-conical portion 166 of eye nut 160 also has a small transverse hole 163 for receiving split pin 165.

In the preferred embodiment, cutting unit 100 has six cutting stars and each cutting star has four cutting blades. The number of cutting stars for each cutting unit and the number of cutting blade for each cutting star can be different. Also the angular arrangement of the cutting blades of the cutting stars can be different.

As mentioned before, the two typical inner diameters of the underground power cable conduit are 4 inches and 5 inches. Accordingly the overall diameters of the cutting units are in two different size arrangements. For each size of the conduits, there are preferably three different sized cutting units: an initial cutting unit with the smallest overall cutting diameter, a middle cutting unit with the medium overall cutting diameter, and a final cutting unit with the largest overall cutting diameter. The overall cutting diameters of the cutting units for the 4 inches and 5 inches inner diameter conduits are shown in Table 2 below (in unit of inches).

TABLE 2

| Conduit/Unit | Initial | Middle | Final |
|---|---|---|---|
| 4" diameter | 3.5 | 3.75 | 4 |
| 5" diameter | 4.5 | 4.75 | 5 |

When used separately, the initial cutting unit is first pulled through a duct having thick blister buildups, and the surface portion of the blister will be scraped off by the initial cutting unit. Then the middle cutting unit is pulled through the duct, and the middle portion of the blister will be scraped off by the middle cutting unit. Finally, the final cutting unit is pulled through the duct, and the underneath portion of the blister adjacent to the interior sidewall of the duct will finally be scraped off by the final cutting unit.

Figure 15:
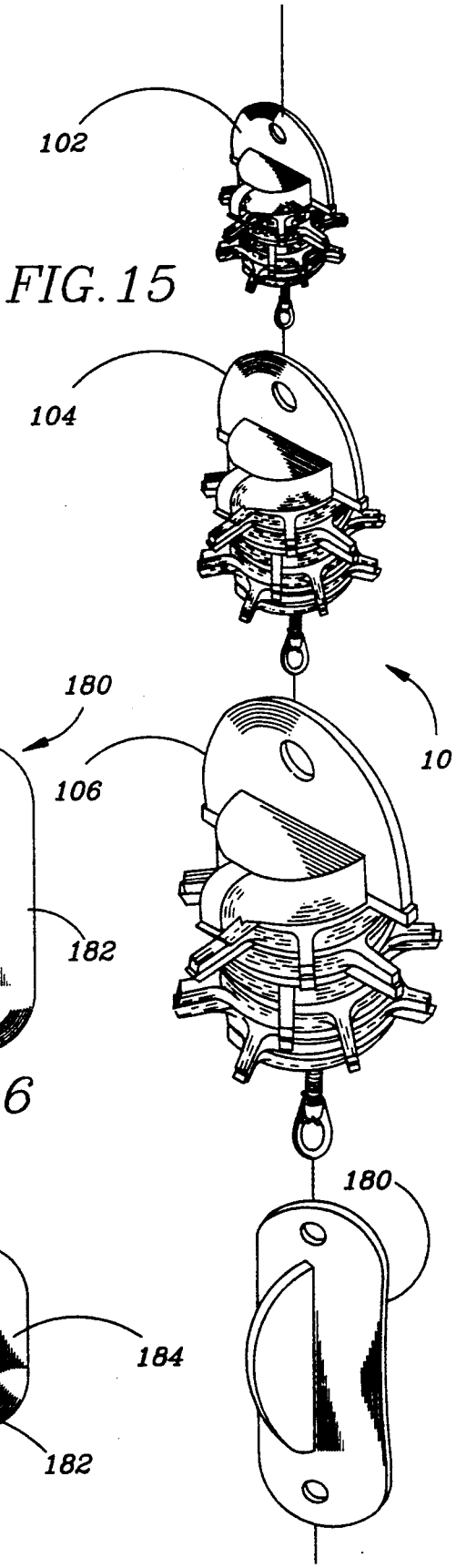
FIG. 15 is a perspective view of a preferred embodiment of the present invention train apparatus.

Preferably, the cutting units are interlinked together to construct a train apparatus. Referring to FIG. 15, there is shown at 10 the present invention train apparatus for removing blisters from a fiber conduit. Train apparatus 10 includes three cutting units 102, 104 and 106, and a trailing guide 180. Of course more or less cutting units may be included. The cutting units and the trailing guide may be interlinked by shackles or cables, so they can be pulled together through an underground duct. In train apparatus 10, cutting unit 102 is the initial cutting unit having the smallest overall cutting diameter, cutting unit 104 is the middle cutting unit having the medium overall cutting diameter, and cutting unit 106 is the final cutting unit having the largest overall cutting diameter.

Figure 16:
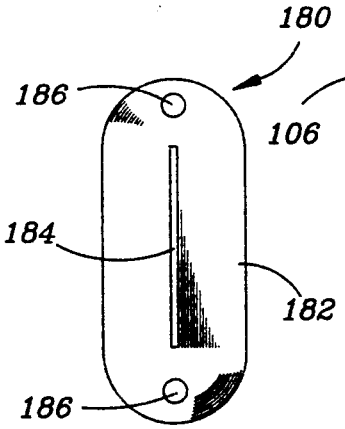
FIG. 16 is a side view of a trailing guide of the present invention train apparatus.
Figure 17:
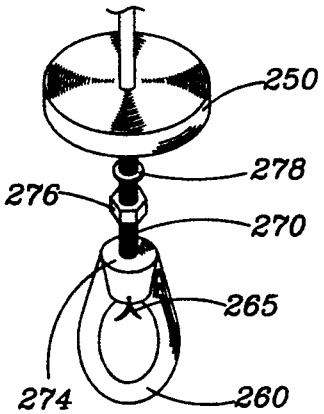
FIG. 17 is an end view of the trailing guide of the present invention train apparatus.
Figure 17:
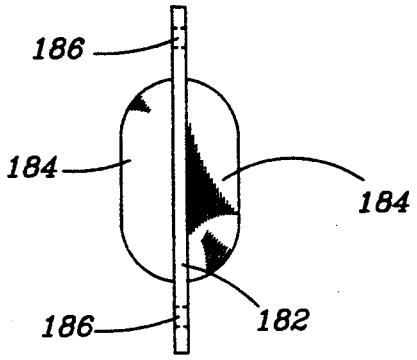

The structure of trailing guide 180 is shown in FIGS. 16 and 17. It has a vertical flat panel 182 having rounded corners. On each side of the vertical panel 182 there is a horizontal wing 184. Two openings 186 are provided at the front and rear end of flat panel 182 respectively for interlinking the trailing guide 180 with pulling cables or ropes, or other cutting units. The purpose of the trailing guide 180 is that if the train apparatus gets stuck in the middle of a duct and it is necessary to pull it out backwardly, it can be pulled out from the rear end, and the trailing guide will prevent the train apparatus from digging into the interior sidewall of the duct as it is pulled out of the duct.

Figure 18:
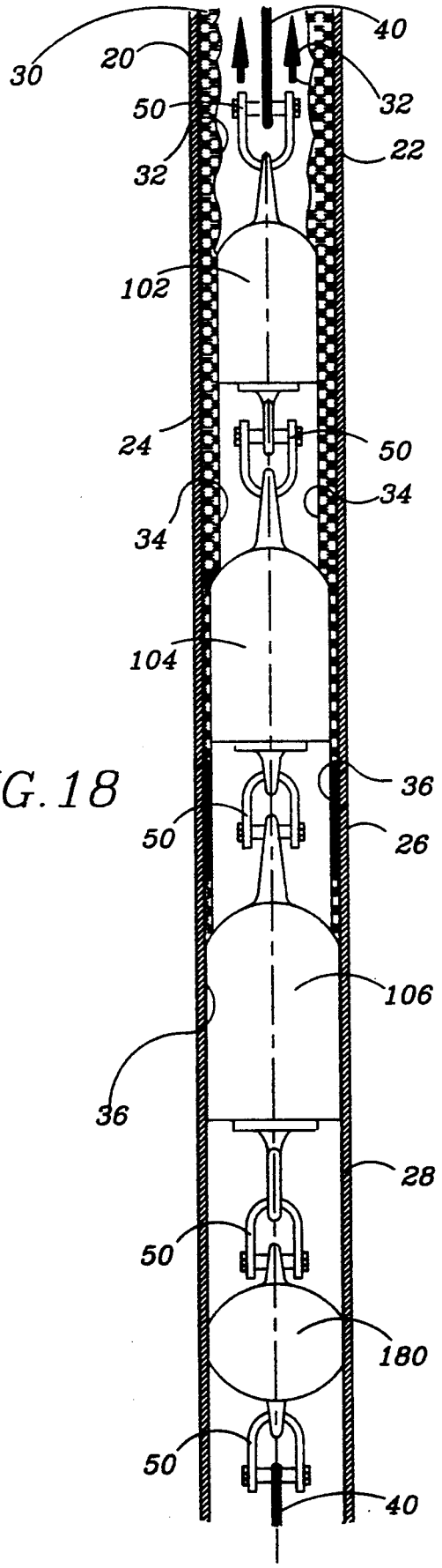
FIG. 18 is an illustration diagram showing how the present invention train apparatus removes blisters from a fiber conduit.

The application of the present invention train apparatus is illustrated in FIG. 18. Shown in FIG. 18, an elongated duct 20 has a very thick blister buildup 30. The present invention train apparatus 10 is pulled through duct 20 by a cable 40. Train apparatus 10 includes an initial cutting unit 102, a middle cutting unit 104, a final cutting unit 106 and a trailing guide 180, all interlinked by shackles 50. From left to right, the blister buildup 32 in the first portion 22 of elongated duct 20 is very thick, and its surface portion is cut off by initial cutting unit 102. After the surface portion of the blister buildup is cut by initial cutting unit 102, the blister layer 34 in the second portion 24 of elongated duct 20 is thinner and the intermediate portion of the blister buildup is exposed. The intermediate portion of the blister buildup is then cut off by middle cutting unit 104. After the intermediate portion of the blister buildup is cut by middle cutting unit 104, the blister layer 36 in the third portion 26 of elongated duct 20 is very thin and the underneath portion of the blister buildup is exposed. The underneath portion of the blister buildup is finally cut off by final cutting unit 106, and in the fourth portion 28 of elongated duct 20 the blister buildup is successfully eliminated.

An alternative embodiment of the present invention cutting unit is shown in FIGS. 19 and 20. Cutting unit 200 has six cutting stars 230 and a circular clamp 250, all assembled on a longitudinally elongated central shaft 270. There are four cutting blades 240 mounted to each cutting star where the four blades are set 90° apart. Screw nuts 276 are threaded to both the front end 272 and the rear end 274 of central shaft 270 with a respective one of the "O" rings 278 inserted for fastening the assembly. Eye nuts 260 are attached to both ends of central shaft 270 respectively by split pins 265.

Figure 21:
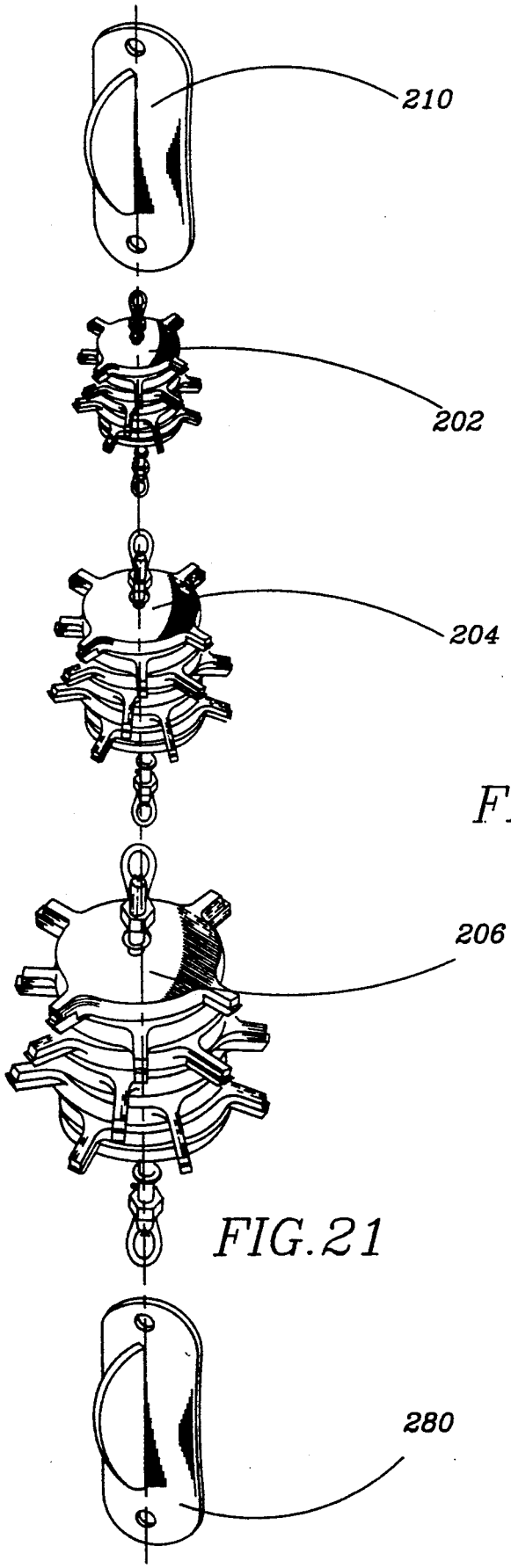
FIG. 21 is a perspective view of an alternative embodiment of the present invention train apparatus.

The difference between cutting units 200 and 100 is that cutting unit 200 does not have its own lead guide, so it is designed for use in a train assembly only where a separate lead guide 210 is used, as shown in FIG. 21. The separate lead guide has the same structure as the trailing guide 280, which is also the same as trailing guide 180 shown in FIGS. 16 and 17. Again the three alternative cutting units 202, 204 and 206 of alternative train apparatus 20 have different overall cutting diameters similar to the ones of train apparatus 10 discussed previously.

A marking system is developed to provide identification for the different sized cutting units and their cutting stars. There are two numbers marked on each cutting star in the format of "#-#". For example, the two numbers marked on the sixth cutting star of the second cutting unit are "2-6". Other symbols may also be incorporated, such as an arrow "←" indicating the assembling direction of a cutting star. The present invention train apparatus and its cutting units can be easily disassembled for cleaning and other purposes. The marking system is therefore provided for quick assembling of the whole apparatus. With the marking system, the cutting stars can be quickly assembled onto the proper cutting unit according to their predetermined angular orientations.

Defined in detail, the present invention is a cutting unit for removing blisters from a fiber conduit, comprising: (a) a longitudinally elongated central shaft having a front end, a rear portion and a rear end, the rear portion having outer screw threads, and the rear end having a small transverse hole; (b) a lead guide having a longitudinal flat panel with a large opening, the flat panel having an arch-shaped front rim, two backwardly disposed rear arms, and a rectangular shaped rear slot between the two rear arms; (c) a lead cutting star having a disc-shaped body portion and two transversely and oppositely extended lateral arms, the body portion having a transverse front side, a transverse rear side and a longitudinal central opening, the rear side having four radially disposed transverse slots, where a first pair of the four transverse slots are aligned with the two lateral arms, and a second pair of the four transverse slots are perpendicular to the two lateral arms; (d) the front end of the central shaft engaged into the central opening of the lead cutting star, and the body portion of the lead cutting star welded in the rear slot of the lead guide, such that the two lateral arms of the lead cutting star are perpendicular to the two rear arms of the lead guide, so that the second pair of the four transverse slots of the lead cutting star are aligned with the two rear arms of the lead guide; (e) a first group of four cutting blades each having a rectangular body portion and a cutting edge, the body portions of the first group of four cutting blades being mounted into the four transverse slots of the lead cutting star respectively by blade mounting means, where a first pair of the first group of four cutting blades are mounted in the first pair of the four transverse slots such that their cutting edges are slightly extended outwardly from the two lateral arms of the lead cutting star to be thereby guided and protected, and a second pair of the first group of four cutting blades are mounted in the second pair of the four transverse slots such that their cutting edges are slightly extended outwardly from the two rear arms of the lead guide to be thereby guided and protected; (f) five regular circular cutting stars each having a disc-shaped body portion and four transversely and radially extended lateral arms set 90° apart, the body portion having a transverse front side, a transverse rear side and a longitudinal central opening for accommodating the central shaft, the rear side having four radially disposed transverse slots aligned with the four lateral arms; (g) each individual one of the five regular cutting stars further comprising a respective group of four cutting blades each having a rectangular body portion and a cutting edge, the body portions of the respective group of four cutting blades being mounted into the four transverse slots of the individual cutting star respectively by blade mounting means such that their cutting edges are slightly extended outwardly from the four lateral arms of the individual cutting star to be thereby guided and protected; (h) alignment means for aligning the cutting stars so that the cutting blades of one cutting star are offset from the cutting blades of the other cutting stars; (i) a circular clamp having a disc-shaped body portion with a longitudinal central opening for accommodating the central shaft; (j) the five regular cutting stars and the circular clamp being assembled onto the central shaft and fastened by a screw nut threaded on the rear portion of the central shaft; (k) an eye nut having a stirrup portion and a frusto-conical portion, the stirrup portion having a large opening, the frusto-conical portion having a longitudinal central opening and a small transverse hole; and (l) the rear end of the central shaft engaged into the central opening of the frusto-conical portion of the eye nut, such that the small transverse hole on the rear end of the central shaft is aligned with the small transverse hole of the frusto-conical portion of the eye nut for receiving a split pin; (m) whereby when the cutting unit is pulled through a fiber conduit by a pulling cable attached to the lead guide, the lead guide will prevent the cutting unit from going off center of the conduit and digging itself into the interior sidewall of the conduit, and the cutting blades of the cutting stars will remove the blisters from the fiber conduit.

In the preferred embodiment of the present invention defined in detail: (a) the blade mounting means includes a small hole adjacent to each of the transverse slots at the rear side of the cutting stars, and a fastening Allen screw threaded therein; and (b) the alignment means includes a small recess on the front side of each of the cutting stars, and a small protrusion on the rear side of each of the cutting stars, such that when the cutting units are assembled, the small protrusion on the rear side of a preceding cutting stars will be engaged with the small recess on the front side of a following cutting star to determine their relative orientation, such that the cutting blades of the following cutting star are offset from the cutting blades of the preceding cutting star.

The overall cutting diameters of the cutting units are defined as follows: (a) for a fiber conduit with 4 inches inner diameter, the overall cutting diameters of the cutting units are approximately 3.5 inches, 3.75 inches and 4 inches respectively; and (b) for a fiber conduit with 5 inches inner diameter, the overall cutting diameters of the cutting units are approximately 4.5 inches, 4.75 inches and 5 inches respectively.

Defined broadly, the present invention is a cutting unit for removing blisters from a fiber conduit, comprising: (a) a longitudinal central shaft having a front end and a rear end; (b) a lead guide having a longitudinal flat panel, the flat panel having an arch-shaped front rim and an opening; (c) six circular cutting stars each having a disc-shaped body portion, the disk-shaped body portion having a transverse front side, a transverse rear side and a longitudinal central opening for accommodating the central shaft, the rear side having four radially disposed transverse slots set 90° apart with cutting blades mounted laterally therein by blade mounting means; (d) alignment means for aligning the cutting stars so that the cutting blades of one cutting star are offset from the cutting blades of the other cutting stars; (e) the six regular cutting stars being assembled onto the central shaft with a circular clamp and fastened by a screw nut threaded on the central shaft; and (f) an eye nut attached to the rear end of the central shaft by a split pin; (g) whereby when the cutting unit is pulled through a fiber conduit by a pulling cable attached to the lead guide, the lead guide will prevent the cutting unit from going off center of the conduit and digging itself into the interior sidewall of the conduit, and the cutting blades of the cutting stars will remove the blisters from the fiber conduit.

Defined more broadly, the present invention is a cutting unit for removing blisters from a fiber conduit, comprising: (a) a lead guide having an arch-shaped panel; (b) six circular cutting stars each having a front side, a rear side, and four lateral cutting blades set 90° apart; and (c) alignment means for aligning the cutting stars so that the cutting blades of one cutting star are offset from the cutting blades of the other cutting stars; (d) whereby when the cutting unit is pulled through a fiber conduit by a pulling cable attached to the lead guide, the lead guide will prevent the cutting unit from going off center of the conduit and digging itself into the interior sidewall of the conduit, and the cutting blades of the cutting stars will remove the blisters from the fiber conduit.

Defined most broadly, the present invention is a cutting unit for removing blisters from a fiber conduit, comprising a multiplicity of circular cutting stars each having a multiplicity of lateral cutting blades, where the cutting blades of one cutting star are offset from the cutting blades of the other cutting stars, whereby when the cutting unit is pulled through a fiber conduit by a pulling cable attached to the lead guide, the cutting blades of the cutting stars will remove the blisters from the fiber conduit.

Alternatively defined in detail, the present invention is a train apparatus for removing thick blister buildups from a fiber conduit, comprising:

(a) three cutting units including an initial cutting unit, a middle cutting unit and a final cutting unit;

(b) each of the three cutting unit further comprising:

(i) a longitudinally elongated central shaft having a front end, a rear portion and a rear end, the rear portion having outer screw threads, and the rear end having a small transverse hole;

(ii) a lead guide having a longitudinal flat panel with a large opening, the flat panel having an arch-shaped front rim, two backwardly disposed rear arms, and a rectangular shaped rear slot between the two rear arms;

(iii) a lead cutting star having a disc-shaped body portion and two transversely and oppositely extended lateral arms, the body portion having a transverse front side, a transverse rear side and a longitudinal central opening, the rear side having four radially disposed transverse slots, where a first pair of the four transverse slots are aligned with the two lateral arms, and a second pair of the four transverse slots are perpendicular to the two lateral arms;

(iv) the front end of the central shaft engaged into the central opening of the lead cutting star, and the body portion of the lead cutting star welded in the rear slot of the lead guide, such that the two lateral arms of the lead cutting star are perpendicular to the two rear arms of the lead guide, so that the second pair of the four transverse slots of the lead cutting star are aligned with the two rear arms of the lead guide;

(v) a first group of four cutting blades each having a rectangular body portion and a cutting edge, the body portions of the first group of four cutting blades being mounted into the four transverse slots of the lead cutting star respectively by blade mounting means, where a first pair of the first group of four cutting blades are mounted in the first pair of the four transverse slots such that their cutting edges are slightly extended outwardly from the two lateral arms of the lead cutting star to be thereby guided and protected, and a second pair of the first group of four cutting blades are mounted in the second pair of the four transverse slots such that their cutting edges are slightly extended outwardly from the two rear arms of the lead guide to be thereby guided and protected;

(vi) five regular circular cutting stars each having a disc-shaped body portion and four transversely and radially extended lateral arms set 90° apart, the body portion having a transverse front side, a transverse rear side and a longitudinal central opening for accommodating the central shaft, the rear side having four radially disposed transverse slots aligned with the four lateral arms;

(vii) each individual one of the five regular cutting stars further comprising a respective group of four cutting blades each having a rectangular body portion and a cutting edge, the body portions of the respective group of four cutting blades being mounted into the four transverse slots of the individual cutting star respectively by blade mounting means such that their cutting edges are slightly extended outwardly from the four lateral arms of the individual cutting star to be thereby guided and protected;

(viii) alignment means for aligning the cutting stars so that the cutting blades of one cutting star are offset from the cutting blades of the other cutting stars;

(ix) a circular clamp having a disc-shaped body portion with a longitudinal central opening for accommodating the central shaft;

(x) the five regular cutting stars and the circular clamp being assembled onto the central shaft and fastened by a screw nut threaded on the rear portion of the central shaft;

(xi) an eye nut having a stirrup portion and a frusto-conical portion, the stirrup portion having a large opening, the frusto-conical portion having a longitudinal central opening and a small transverse hole; and (xii) the rear end of the central shaft engaged into the central opening of the frusto-conical portion of the eye nut, such that the small transverse hole on the rear end of the central shaft is aligned with the small transverse hole of the frusto-conical portion of the eye nut for receiving a split pin;

(c) the initial cutting unit having a smallest overall cutting diameter, the middle cutting unit having a medium overall cutting diameter, and the final unit having a largest overall cutting diameter;

(d) a trailing guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim; and (e) connecting means interlinking the three cutting units in series and followed by the trailing guide;

(f) whereby when the train apparatus is pulled through a fiber conduit by a pulling cable attached to the lead guide of the initial unit, the lead guide of each individual cutting unit will prevent the individual cutting unit from going off center of the conduit and digging itself into the interior sidewall of the conduit, the cutting blades of the initial cutting unit will remove the surface portion of thick blister buildups, the middle cutting unit will remove the intermediate portion of thick blister buildups, and the final cutting unit will remove the underneath portion of thick blister buildups; and when stuck inside the fiber conduit, the train apparatus can be pulled out backwardly by a trailing cable attached to the trailing guide and the trailing guide will prevent the train apparatus from going off center of the conduit and digging itself into the interior sidewall of the conduit.

In the alternative embodiment of the present invention defined in detail the connecting means are shackles.

The overall cutting diameters of the cutting units of the train apparatus are defined as follows: (a) for a fiber conduit with 4 inches inner diameter, the overall cutting diameters of the initial, middle and final cutting units are approximately 3.5 inches, 3.75 inches and 4 inches respectively; and (b) for a fiber conduit with 5 inches inner diameter, the overall cutting diameters of the initial, middle and final cutting units are approximately 4.5 inches, 4.75 inches and 5 inches respectively.

Defined broadly, the alternative embodiment of the present invention is a train apparatus for removing thick blister buildups from a fiber conduit, comprising:

(a) three cutting units including an initial cutting unit, a middle cutting unit and a final cutting unit;

(b) each of the three cutting unit further comprising:

(i) a longitudinal central shaft having a front end and a rear end;

(ii) a lead guide having a longitudinal flat panel, the flat panel having an arch-shaped front rim and an opening;

(iii) six circular cutting stars each having a disc-shaped body portion, the body portion having a transverse front side, a transverse rear side and a longitudinal central opening for accommodating the central shaft, the rear side having four radially disposed transverse slots set 90° apart with cutting blades mounted laterally therein by blade mounting means;

(iv) alignment means for aligning the cutting stars so that the cutting blades of one cutting star are offset from the cutting blades of the other cutting stars;

(v) the six regular cutting stars being assembled onto the central shaft with a circular clamp and fastened by a screw nut threaded on the central shaft; and (vi) an eye nut attached to the rear end of the central shaft by a split pin;

(c) the initial cutting unit having a smallest overall cutting diameter, the middle cutting unit having a medium overall cutting diameter, and the final unit having a largest overall cutting diameter;

(d) a trailing guide having a longitudinal flat panel with two oppositely disposed flat wings, the flat panel having an arched-shaped front rim and an arched-shaped rear rim, and a front opening adjacent to the front rim, and a rear opening adjacent to the rear rim; and (e) connecting means interlinking the three cutting units in series and followed by the trailing guide;

(f) whereby when the train apparatus is pulled through a fiber conduit by a pulling cable attached to the lead guide of the initial unit, the lead guide of each individual cutting unit will prevent the individual cutting unit from going off center of the conduit and digging itself into the interior sidewall of the conduit, the cutting blades of the initial cutting unit will remove the surface portion of thick blister buildups, the middle cutting unit will remove the intermediate portion of thick blister buildups, and the final cutting unit will remove the underneath portion of thick blister buildups; and when stuck inside the fiber conduit, the train apparatus can be pulled out backwardly by a trailing cable attached to the trailing guide and the trailing guide will prevent the train apparatus from going off center of the conduit and digging itself into the interior sidewall of the conduit.

Defined more broadly, the alternative embodiment of the present invention is a train apparatus for removing thick blister buildups from a fiber conduit, comprising:

(a) three cutting units including an initial cutting unit, a middle cutting unit and a final cutting unit;

(b) each of the three cutting unit further comprising:

(i) a lead guide having an arch-shaped panel;

(ii) six circular cutting stars each having a front side, a rear side, and four lateral cutting blades set 90° apart; and (iii) alignment means for aligning the cutting stars so that the cutting blades of one cutting star are offset from the cutting blades of the other cutting stars;

(c) the initial cutting unit having a smallest overall cutting diameter, the middle cutting unit having a medium overall cutting diameter, and the final unit having a largest overall cutting diameter;

(d) a trailing guide having a longitudinal flat panel with two oppositely disposed flat wings, the flat panel having an arched-shaped front rim and an arched-shaped rear rim, and a front opening adjacent to the front rim, and a rear opening adjacent to the rear rim; and (e) connecting means interlinking the three cutting units in series;

(f) whereby when the train apparatus is pulled through a fiber conduit by a pulling cable attached to the lead guide of the initial unit, the lead guide of each individual cutting unit will prevent the individual cutting unit from going off center of the conduit and digging itself into the interior sidewall of the conduit, the cutting blades of the initial cutting unit will remove the surface portion of thick blister buildups, the middle cutting unit will remove the intermediate portion of thick blister buildups, and the final cutting unit will remove the underneath portion of thick blister buildups; and when stuck inside the fiber conduit, the train apparatus can be pulled out backwardly by a trailing cable attached to the trailing guide and the trailing guide will prevent the train apparatus from going off center of the conduit and digging itself into the interior sidewall of the conduit.

Defined most broadly, the alternative embodiment of the present invention is a train apparatus for removing thick blister buildups from a fiber conduit, comprising: (a) a multiplicity of cutting units including an initial cutting unit and a final cutting unit; (b) each of the three cutting unit further comprising a multiplicity of circular cutting stars each having a multiplicity of lateral cutting blades, where the cutting blades of one cutting star are offset from the cutting blades of the other cutting stars; (c) the initial cutting unit having a smallest overall cutting diameter, and the final unit having a largest overall cutting diameter; and (d) connecting means interlinking the multiplicity of cutting units in series; (e) whereby when the train apparatus is pulled through a fiber conduit by a pulling cable attached to the lead guide of the initial unit, the lead guide of each individual cutting unit will prevent the individual cutting unit from going off center of the conduit and digging itself into the interior sidewall of the conduit, the cutting blades of the initial cutting unit will remove the surface portion of thick blister buildups, and the final cutting unit will remove the underneath portion of thick blister buildups.

Also defined alternatively in detail, one of the alternative embodiments of the present invention is a cutting unit for removing blisters from a fiber conduit, comprising: (a) a longitudinally elongated central shaft having a front portion with a front end and a rear portion with a rear end, the front end having a front transverse hole, the rear end having a rear transverse hole, and both the front and the rear portions having outer screw threads; (b) six regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms; (c) each individual one of said six regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected; (d) alignment means for aligning said cutting stars so that the cutting blades of one cutting star are offset from the cutting blades of the other cutting stars; (e) a circular clamp having a disc-shaped body portion with a longitudinal central opening for accommodating said central shaft; (f) said six regular cutting stars and said circular clamp being assembled onto said central shaft and fastened by a front screw nut threaded on said front portion of said central shaft and a rear screw nut threaded on said rear portion of said central shaft; (g) a front eye nut having a stirrup portion and a frusto-conical portion, the stirrup portion having a large opening, the frusto-conical portion having a longitudinal central opening and a small transverse hole; (h) said front end of said central shaft engaged into said central opening of said frusto-conical portion of said front eye nut, such that said front transverse hole on said front end of said central shaft is aligned with said small transverse hole of said frusto-conical portion of said front eye nut for receiving a first split pin; (i) a rear eye nut having a stirrup portion and a frusto-conical portion, the stirrup portion having a large opening, the frusto-conical portion having a longitudinal central opening and a small transverse hole; and (j) said rear end of said central shaft engaged into said central opening of said frusto-conical portion of said rear eye nut, such that said rear transverse hole on said rear end of said central shaft is aligned with said small transverse hole of said frusto-conical portion of said rear eye nut for receiving a second split pin; (k) whereby when said cutting unit is pulled through a fiber conduit by a pulling cable attached to said front eye nut, said cutting blades of said cutting stars will remove the blisters from the fiber conduit.

Again defined alternatively in detail, another one of the alternative embodiments of the present invention is a train apparatus for removing thick blister buildups from a fiber conduit, comprising:

(a) three cutting units including an initial cutting unit, a middle cutting unit and a final cutting unit;

(b) each of said three cutting units further comprising:

(i) a longitudinally elongated central shaft having a front portion with a front end and a rear portion with a rear end, the front end having a front transverse hole, the rear end having a rear transverse hole, and both the front and the rear portions having outer screw threads;

(ii) six regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms;

(iii) each individual one of said six regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected;

(iv) alignment means for aligning said cutting stars so that the cutting blades of one cutting star are offset from the cutting blades of the other cutting stars;

(v) a circular clamp having a disc-shaped body portion with a longitudinal central opening for accommodating said central shaft;

(vi) said six regular cutting stars and said circular clamp being assembled onto said central shaft and fastened by a front screw nut threaded on said front portion of said central shaft and a rear screw nut threaded on said rear portion of said central shaft;

(vii) a front eye nut having a stirrup portion and a frusto-conical portion, the stirrup portion having a large opening, the frusto-conical portion having a longitudinal central opening and a small transverse hole;

(viii) said front end of said central shaft engaged into said central opening of said frusto-conical portion of said front eye nut, such that said front transverse hole on said front end of said central shaft is aligned with said small transverse hole of said frusto-conical portion of said front eye nut for receiving a first split pin;

(ix) a rear eye nut having a stirrup portion and a frusto-conical portion, the stirrup portion having a large opening, the frusto-conical portion having a longitudinal central opening and a small transverse hole; and (x) said rear end of said central shaft engaged into said central opening of said frusto-conical portion of said rear eye nut, such that said rear transverse hole on said rear end of said central shaft is aligned with said small transverse hole of said frusto-conical portion of said rear eye nut for receiving a second split pin;

(c) said initial cutting unit having a smallest overall cutting diameter, said middle cutting unit having a medium overall cutting diameter, and said final cutting unit having a largest overall cutting diameter;

(d) a lead guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim;

(e) a trailing guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim; and (f) connecting means interlinking said lead guide, said three cutting units and said trailing guide in series;

(g) whereby when said train apparatus is pulled through a fiber conduit by a pulling cable attached to said lead guide, said lead guide will prevent the train apparatus from going off center of the conduit and digging itself into the interior sidewall of the conduit, said cutting blades of said initial cutting unit will remove the surface portion of thick blister buildups, said middle cutting unit will remove the intermediate portion of thick blister buildups, and said final cutting unit will remove the underneath portion of thick blister buildups; and when stuck inside the fiber conduit, said train apparatus can be pulled out backwardly by a trailing cable attached to said trailing guide and said trailing guide will prevent said train apparatus from going off center of the conduit and digging itself into the interior sidewall of the conduit.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A cutting unit for removing blisters from a fiber conduit, comprising:

a. a longitudinal central shaft having a front end and a rear end;

b. a lead guide having a longitudinal flat panel, the flat panel having an arch-shaped front rim and an opening;

c. six circular cutting stars each having a disc-shaped body portion, the disc-shaped body portion having a transverse front side, a transverse rear side and a longitudinal central opening for accommodating said central shaft, the rear side having four radially disposed transverse slots set 90° apart with cutting blades mounted laterally therein by blade mounting means;

d. alignment means for aligning said cutting stars so that the cutting blades of one cutting star are offset from the cutting blades of the other cutting stars;

e. said six regular cutting stars being assembled onto said central shaft with a circular clamp and fastened by a screw nut threaded on said central shaft; and f. an eye nut attached to said rear end of said central shaft by a split pin;

g. whereby when said cutting unit is pulled through a fiber conduit by a pulling cable attached to said lead guide, said lead guide will prevent said cutting unit from going off center of the conduit and digging itself into the interior sidewall of the conduit, and said cutting blades of said cutting stars will remove the blisters from the fiber conduit.

2. The invention as defined in claim 1 wherein said blade mounting means includes a small hole adjacent to each of said transverse slots at said rear side of said cutting stars, and a fastening allen screw threaded therein.

3. The invention as defined in claim 1 wherein said alignment means includes a small recess on said front side of each of said cutting stars, and a small protrusion on said rear side of each of said cutting stars, such that when said cutting unit is assembled, the small protrusion on the rear side of a preceding cutting star will be engaged with the small recess on the front side of a following cutting star to determine their relative orientation, such that the cutting blades of the following cutting star are offset from the cutting blades of the preceding cutting star.

4. A cutting unit for removing blisters from a fiber conduit, comprising:

a. a longitudinally elongated central shaft having a front end, a rear portion and a rear end, the rear portion having outer screw threads, and the rear end having a small transverse hole;

b. a lead guide having a longitudinal flat panel with a large opening, the flat panel having an arch-shaped front rim, two backwardly disposed rear arms, and a rectangular shaped rear slot between the two rear arms;

c. a lead cutting star having a disc-shaped body portion and two transversely and oppositely extended lateral arms, the disc-shaped body portion having a transverse front side, a transverse rear side and a longitudinal central opening, the rear side having four radially disposed transverse slots, where a first pair of the four transverse slots are aligned with the two lateral arms, and a second pair of the four transverse slots are perpendicular to the two lateral arms;

d. said front end of said central shaft engaged into said central opening of said lead cutting star, and said body portion of said lead cutting star welded in said rear slot of said lead guide, such that said two lateral arms of said lead cutting star are perpendicular to said two rear arms of said lead guide, so that said second pair of said four transverse slots of said lead cutting star are aligned with said two rear arms of said lead guide;

e. a first group of four cutting blades each having a rectangular body portion and a cutting edge, the body portions of the first group of four cutting blades being mounted into said four transverse slots of said lead cutting star respectively by blade mounting means, where a first pair of the first group of four cutting blades are mounted in said first pair of said four transverse slots such that their cutting edges ar slightly extended outwardly from said two lateral arms of said lead cutting star to be thereby guided and protected, and a second pair of the first group of four cutting blades are mounted in said second pair of said four transverse slots such that their cutting edges are slightly extended outwardly from said two rear arms of said lead guide to be thereby guided and protected;

f. five regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms;

g. each individual one of said five regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected;

h. alignment means for aligning said cutting stars so that the cutting blades of one cutting star are offset from the cutting blades of the other cutting stars;

i. a circular clamp having a disc-shaped body portion with a longitudinal central opening for accommodating said central shaft;

j. said five regular cutting stars and said circular clamp being assembled onto said central shaft and fastened by a screw nut threaded on said rear portion of said central shaft;

k. an eye nut having a stirrup portion and a frusto-conical portion, the stirrup portion having a large opening, the frusto-conical portion having a longitudinal central opening and a small transverse hole; and l. said rear end of said central shaft engaged into said central opening of said frusto-conical portion of said eye nut, such that said small transverse hole on said rear end of said central shaft is aligned with said small transverse hole of said frusto-conical portion of said eye nut for receiving a split pin;

m. whereby when said cutting unit is pulled through a fiber conduit by a pulling cable attached to said lead guide, said lead guide will prevent said cutting unit from going off center of the conduit and digging itself into the interior sidewall of the conduit, and said cutting blades of said cutting stars will remove the blisters from the fiber conduit.

5. The invention as defined in claim 4 wherein said blade mounting means includes a small hole adjacent to each of said transverse slots at said rear side of said cutting stars, and a fastening allen screw threaded therein.

6. The invention as defined in claim 4 wherein said alignment means includes a small recess on said front side of each of said cutting stars, and a small protrusion on said rear side of each of said cutting stars, such that when said cutting unit is assembled, the small protrusion on the rear side of a preceding cutting star will be engaged with the small recess on the front side of a following cutting star to determine their relative orientation, such that the cutting blades of the following cutting star are offset from the cutting blades of the preceding cutting star.

7. The invention as defined in claim 4 wherein the overall cutting diameter of said cutting unit is approximately 3.5 inches for removing the surface portion of thick blister buildups from a fiber conduit with 4 inches inner diameter.

8. The invention as defined in claim 4 wherein the overall diameter of said cutting unit is approximately 3.75 inches for removing the intermediate portion of thick blister buildups from a fiber conduit with 4 inches inner diameter after the surface portion of the blister buildups has been removed.

9. The invention as defined in claim 4 wherein the overall diameter of said cutting unit is approximately 4 inches for removing the underneath portion of thick blister buildups from a fiber conduit with 4 inches inner diameter after the intermediate portion of the blister buildups has been removed.

10. The invention as defined in claim 4 wherein the overall cutting diameter of said cutting unit is approximately 4.5 inches for removing the surface portion of thick blister buildups from a fiber conduit with 5 inches inner diameter.

11. The invention as defined in claim 4 wherein the overall diameter of said cutting unit is approximately 4.75 inches for removing the medium portion of thick blister buildups from a fiber conduit with 5 inches inner diameter after the surface portion of the blister buildups has been removed.

12. The invention as defined in claim 4 wherein the overall diameter of said cutting unit is approximately 5 inches for removing the underneath portion of thick blister buildups from a fiber conduit with 5 inches inner diameter after the medium portion of the blister buildups has been removed.

13. A train apparatus for removing thick blister buildups from a fiber conduit, comprising:

a. three cutting units including an initial cutting unit, a middle cutting unit and a final cutting unit;

b. each of said three cutting unit further comprising:
   (i) a lead guide having an arch-shaped panel;
   (ii) six circular cutting stars each having a front side, a rear side, and four lateral cutting blades set 90° apart; and
   (iii) alignment means for aligning said cutting stars so that the cutting blades of one cutting star are offset from the cutting blades of the other cutting stars;

c. said initial cutting unit having a smallest overall cutting diameter, said middle cutting unit having a medium overall cutting diameter, and said final unit having a largest overall cutting diameter;

d. a trailing guide having a longitudinal flat panel with two oppositely disposed flat wings, the flat panel having an arched-shaped front rim and an arched-shaped rear rim, and a front opening adjacent to the front rim, and a rear opening adjacent to the rear rim; and e. connecting means interlinking said three cutting units and said trailing guide in series;

f. whereby when said train apparatus is pulled through a fiber conduit by a pulling cable attached to said lead guide of said initial unit, said lead guide of each individual cutting unit will prevent the individual cutting unit from going off center of the conduit and digging itself into the interior sidewall of the conduit, said cutting blades of said initial cutting unit will remove the surface portion of thick blister buildups, said middle cutting unit will remove the intermediate portion of thick blister buildups, and said final cutting unit will remove the underneath portion of thick blister buildups; and when stuck inside the fiber conduit, said train apparatus can be pulled out backwardly by a trailing cable attached to said trailing guide and said trailing guide will prevent said train apparatus from going-off center of the conduit and digging itself into the interior sidewall of the conduit.

14. The invention as defined in claim 13 wherein said connecting means are shackles.

15. A train apparatus for removing thick blister buildups from a fiber conduit, comprising:

a. three cutting units including an initial cutting unit, a middle cutting unit and a final cutting unit;

b. each of said three cutting unit further comprising:

(i) a longitudinally elongated central shaft having a front end, a rear portion and a rear end, the rear portion having outer screw threads, and the rear end having a small transverse hole;

(ii) a lead guide having a longitudinal flat panel with a large opening, the flat panel having an arch-shaped front rim, two backwardly disposed rear arms, and a rectangular shaped rear slot between the two rear arms;

(iii) a lead cutting star having a disc-shaped body portion and two transversely and oppositely extended lateral arms, the disc-shaped body portion having a transverse front side, a transverse rear side and a longitudinal central opening, the rear side having four radially disposed transverse slots, where a first pair of the four transverse slots are aligned with the two lateral arms, and a second pair of the four transverse slots are perpendicular to the two lateral arms;

(iv) said front end of said central shaft engaged into said central opening of said lead cutting star, and said body portion of said lead cutting star welded in said rear slot of said lead guide, such that said two lateral arms of said lead cutting star are perpendicular to said two rear arms of said lead guide, so that said second pair of said four transverse slots of said lead cutting star are aligned with said two rear arms of said lead guide;

(v) a first group of four cutting blades each having a rectangular body portion and a cutting edge, the body portions of the first group of four cutting blades being mounted into said four transverse slots of said lead cutting star respectively by blade mounting means, where a first pair of the first group of four cutting blades are mounted in said first pair of said four transverse slots such that their cutting edges are slightly extended outwardly from said two lateral arms of said lead cutting star to be thereby guided and protected, and a second pair of the first group of four cutting blades are mounted in said second pair of said four transverse slots such that their cutting edges are slightly extended outwardly from said two rear arms of said lead guide to be thereby guided and protected;

(vi) five regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms;

(vii) each individual one of said five regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected;

(viii) alignment means for aligning said cutting stars so that the cutting blades of one cutting star are offset from the cutting blades of the other cutting stars;

(ix) a circular clamp having a disc-shaped body portion with a longitudinal central opening for accommodating said central shaft;

(x) said five regular cutting stars and said circular clamp being assembled onto said central shaft and fastened by a screw nut threaded on said rear portion of said central shaft;

(xi) an eye nut having a stirrup portion and a frusto-conical portion, the stirrup portion having a large opening, the frusto-conical portion having a longitudinal central opening and a small transverse hole; and (xii) said rear end of said central shaft engaged into said central opening of said frusto-conical portion of said eye nut, such that said small transverse hole on said rear end of said central shaft is aligned with said small transverse hole of said frusto-conical portion of said eye nut for receiving a split pin;

c. said initial cutting unit having a smallest overall cutting diameter, said middle cutting unit having a medium overall cutting diameter, and said final cutting unit having a largest overall cutting diameter;

d. a trailing guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim; and e. connecting means interlinking said three cutting units and said trailing guide in series;

f. whereby when said train apparatus is pulled through a fiber conduit by a pulling cable attached to said lead guide of said initial unit, said lead guide of each individual cutting unit will prevent the individual cutting unit from going off center of the conduit and digging itself into the interior sidewall of the conduit, said cutting blades of said initial cutting unit will remove the surface portion of thick blister buildups, said middle cutting unit will remove the intermediate portion of thick blister buildups, and said final cutting unit will remove the underneath portion of thick blister buildups; and when stuck inside the fiber conduit, said train apparatus can be pulled out backwardly by a trailing cable attached to said trailing guide and said trailing guide will prevent said train apparatus from going off center of the conduit and digging itself into the interior sidewall of the conduit.

16. The invention as defined in claim 15 wherein said connecting means are shackles.

17. The invention as defined in claim 15 wherein the overall cutting diameter of said initial cutting unit is approximately 3.5 inches, the overall diameter of said middle cutting unit is approximately 3.75 inches, and the overall diameter of said final cutting unit is approximately 4 inches.

18. The invention as defined in claim 15 wherein the overall cutting diameter of said initial cutting unit is approximately 4.5 inches, the overall diameter of said middle cutting unit is approximately 4.75 inches, and the overall diameter of said final cutting unit is approximately 5 inches.

19. A train apparatus for removing thick blister buildups from a fiber conduit comprising:

a. a multiplicity of cutting units including an initial cutting unit and a final cutting unit;

b. each of said multiplicity of cutting units further comprising a multiplicity of circular cutting stars each having a multiplicity of lateral cutting blades, where the cutting blades of one cutting star are offset from the cutting blades of the other cutting stars in each cutting unit;

c. said initial cutting unit having a smallest overall cutting diameter, and said final cutting unit having a largest overall cutting diameter;

d. connecting means interlinking said multiplicity of cutting units in series; and e. a trailing guide having a longitudinal flat panel with two oppositely disposed flat wings;

f. whereby when said train apparatus is pulled through a fiber conduit, said cutting blades of said initial cutting unit will remove the surface portion of thick blister buildups, and said cutting blades of said final cutting unit will remove the underneath portion of thick blister buildups, when stuck inside the fiber conduit, said train apparatus can be pulled out backwardly by a trailing cable attached to the trailing guide and the trailing guide will prevent said train apparatus from going-off center of the conduit and digging itself into the interior sidewall of the conduit.

20. A cutting unit for removing blisters from a fiber conduit, comprising:

a. a longitudinally elongated central shaft having a front portion with a front end and a rear portion with a rear end, the front end having a front transverse hole, the rear end having a rear transverse hole, and both the front and the rear portions having outer screw threads;

b. six regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms;

c. each individual one of said six regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected;

d. alignment means for aligning said cutting stars so that the cutting blades of one cutting star are offset from the cutting blades of the other cutting stars;

e. a circular clamp having a disc-shaped body portion with a longitudinal central opening for accommodating said central shaft;

f. said six regular cutting stars and said circular clamp being assembled onto said central shaft and fastened by a front screw nut threaded on said front portion of said central shaft and a rear screw nut threaded on said rear portion of said central shaft;

g. a front eye nut having a stirrup portion and a frusto-conical portion, the stirrup portion having a large opening, the frusto-conical portion having a longitudinal central opening and a small transverse hole;

h. said front end of said central shaft engaged into said central opening of said frusto-conical portion of said front eye nut, such that said front transverse hole on said front end of said central shaft is aligned with said small transverse hole of said frusto-conical portion of said front eye nut for receiving a first split pin;

i. a rear eye nut having a stirrup portion and a frusto-conical portion, the stirrup portion having a large opening, the frusto-conical portion having a longitudinal central opening and a small transverse hole; and j. said rear end of said central shaft engaged into said central opening of said frusto-conical portion of said rear eye nut, such that said rear transverse hole on said rear end of said central shaft is aligned with said small transverse hole of said frusto-conical portion of said rear eye nut for receiving a second split pin;

k. whereby when said cutting unit is pulled through a fiber conduit by a pulling cable attached to said front eye nut, said cutting blades of said cutting stars will remove the blisters from the fiber conduit.

21. A train apparatus for removing thick blister buildups from a fiber conduit, comprising:

a. three cutting units including an initial cutting unit, a middle cutting unit and a final cutting unit;

b. each of said three cutting unit further comprising:

(i) a longitudinally elongated central shaft having a front portion with a front end and a rear portion with a rear end, the front end having a front transverse hole, the rear end having a rear transverse hole, and both the front and the rear portions having outer screw threads;

(ii) six regular circular cutting stars each having a disc-shaped body portion and four transversely and radially extended lateral arms set 90° apart, the disc-shaped body portion having a transverse front side, a transverse rear side and a longitudinal central opening for accommodating said central shaft, the rear side having four radially disposed transverse slots aligned with the four lateral arms;

(iii) each individual one of said six regular cutting stars further comprising a respective group of four cutting blades each having a rectangular body portion and a cutting edge, the body portions of the respective group of four cutting blades being mounted into said four transverse slots of the individual cutting star respectively by blade mounting means such that their cutting edges are slightly extended outwardly from said four lateral arms of the individual cutting star to be thereby guided and protected;

(iv) alignment means for aligning said cutting stars so that the cutting blades of one cutting star are offset from the cutting blades of the other cutting stars;

(v) a circular clamp having a disc-shaped body portion with a longitudinal central opening for accommodating said central shaft;

(vi) said six regular cutting stars and said circular clamp being assembled onto said central shaft and fastened by a front screw nut threaded on said front portion of said central shaft and a rear screw nut threaded on said rear portion of said central shaft;

(vii) a front eye nut having a stirrup portion and a frusto-conical portion, the stirrup portion having a large opening, the frusto-conical portion having a longitudinal central opening and a small transverse hole;

(viii) said front end of said central shaft engaged into said central opening of said frusto-conical portion of said front eye nut, such that said front transverse hole on said front end of said central shaft is aligned with said small transverse hole of said frusto-conical portion of said front eye nut for receiving a first split pin;

(ix) a rear eye nut having a stirrup portion and a frusto-conical portion, the stirrup portion having a large opening, the frusto-conical portion having a longitudinal central opening and a small transverse hole; and (x) said rear end of said central shaft engaged into said central opening of said frusto-conical portion of said rear eye nut, such that said rear transverse hole on said rear end of said central shaft is aligned with said small transverse hole of said frusto-conical portion of said rear eye nut for receiving a second split pin;

c. said initial cutting unit having a smallest overall cutting diameter, said middle cutting unit having a medium overall cutting diameter, and said final cutting unit having a largest overall cutting diameter;

d. a lead guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim;

e. a trailing guide having a large longitudinal flat panel with two oppositely disposed half-oval shaped flat wings which are perpendicular to the flat panel, the flat panel having an arched-shaped front rim and an arched-shaped rear rim, and a large front opening adjacent to the front rim, and a large rear opening adjacent to the rear rim; and f. connecting means interlinking said lead guide, said three cutting units and said trailing guide in series;

g. whereby when said train apparatus is pulled through a fiber conduit by a pulling cable attached to said lead guide, said lead guide will prevent the train apparatus from going off center of the conduit and digging itself into the interior sidewall of the conduit, said cutting blades of said initial cutting unit will remove the surface portion of thick blister buildups, said middle cutting unit will remove the intermediate portion of thick blister buildups, and said final cutting unit will remove the underneath portion of thick blister buildups; and when stuck inside the fiber conduit, said train apparatus can be pulled out backwardly by a trailing cable attached to said trailing guide and said trailing guide will prevent said train apparatus from going off center of the conduit and digging itself into the interior sidewall of the conduit.

22. A cutting unit for removing blisters from a fiber conduit, comprising:

a. a longitudinal central shaft having a front end and a rear end;

b. a lead guide having a longitudinal flat panel with an arch-shaped front rim;

c. a multiplicity of circular cutting stars each having a disc-shaped body portion, the disc-shaped body portion having a transverse front side, a transverse rear side and a longitudinal central opening for accommodating said central shaft, the rear side having a multiplicity of radially disposed transverse slots with cutting blades mounted laterally therein by blade mounting means;

d. alignment means for aligning said cutting stars so that the cutting blades of one cutting star are offset from the cutting blades of the other cutting stars; and e. means for securing said multiplicity of cutting stars onto said central shaft and fastened thereon;

f. whereby when said cutting unit is pulled through a fiber conduit by a pulling cable attached to said lead guide, said lead guide will prevent said cutting unit from going off center of the conduit and digging itself into the interior sidewall of the conduit, and said cutting blades of said cutting stars will remove the blisters from the fiber conduit.

23. The invention as defined in claim 22 wherein said blade mounting means includes a small hole adjacent to each of said transverse slots at said rear side of said cutting stars, and a fastening allen screw threaded therein.

24. The invention as defined in claim 22 wherein said alignment means includes a small recess on said front side of each of said cutting stars, and a small protrusion on said rear side of each of said cutting stars, such that when said cutting unit is assembled, the small protrusion on the rear side of a preceding cutting star will be engaged with the small recess on the front side of a following cutting star to determine their relative orientation, such that the cutting blades of the following cutting star are offset from the cutting blades of the preceding cutting star.

* * * * *